US006962502B2

(12) United States Patent
Kind et al.

(10) Patent No.: US 6,962,502 B2
(45) Date of Patent: Nov. 8, 2005

(54) ELECTRICAL PLUG-AND-SOCKET CONNECTOR HAVING A LATCHING ELEMENT

(75) Inventors: Klaus Kind, Neuenrade (DE); Jürgen Hessmert, Halver (DE)

(73) Assignee: Leopold Kostal GmbH & Co. KG, Ludenscheid (DE)

( * ) Notice: Subject to any disclaimer, the term of this patent is extended or adjusted under 35 U.S.C. 154(b) by 0 days.

(21) Appl. No.: 11/045,890

(22) Filed: Jan. 28, 2005

(65) Prior Publication Data

US 2005/0130481 A1 Jun. 16, 2005

Related U.S. Application Data

(63) Continuation of application No. PCT/EP04/07704, filed on Jul. 13, 2004.

(30) Foreign Application Priority Data

Jul. 15, 2003 (DE) ..... 103 31 935

(51) Int. Cl.[7] ..... H01R 13/627
(52) U.S. Cl. ..... 439/353; 439/352; 439/357
(58) Field of Search ..... 439/353, 354, 439/352, 357, 155

(56) References Cited

U.S. PATENT DOCUMENTS 4,884,046 A 11/1989 Spinner
5,217,385 A * 6/1993 Inoue et al. ..... 439/353
5,219,459 A * 6/1993 Kaneko ..... 439/157
5,655,916 A * 8/1997 Hayashi ..... 439/155
5,746,619 A * 5/1998 Harting et al. ..... 439/352
2003/0143885 A1 * 7/2003 Nishide et al. ..... 439/352

FOREIGN PATENT DOCUMENTS

DE 18 55 747 8/1962
DE 37 27 200 A1 2/1989
DE 42 43 268 A1 6/1994
DE 199 61 708 C1 8/2001

* cited by examiner

*Primary Examiner*—Hae Moon Hyeon
(74) *Attorney, Agent, or Firm*—Brooks Kushman P.C.

(57) ABSTRACT

An electrical plug-and-socket connector includes first and second connector parts which each have a chamber housing to respectively hold complementary first and second contacts. The second part includes a catch. A latching element is adjustably connected to the first part to be movable from a latching position to a tensioned position. When the parts are joined together along a first axial direction the parts have axial play with respect to one another to enable the latching element to latch behind the catch to prevent withdrawal of the parts from one another when the latching element is in the latching position. The latching element is tensioned to move in a second axial direction opposite to the first axial direction in order to eliminate the axial play between the parts while latching the parts together when the latching element is in the tensioned position.

16 Claims, 2 Drawing Sheets

ELECTRICAL PLUG-AND-SOCKET CONNECTOR HAVING A LATCHING ELEMENT

CROSS-REFERENCE TO RELATED APPLICATIONS

This is a continuation of International Application PCT/EP04/07704 , published in German, with an international filing date of Jul. 13, 2004, which claims priority to DE 103 31 935.2, filed Jul. 15, 2003, which are both hereby incorporated by reference.

BACKGROUND OF THE INVENTION

1. Field of the Invention

The present invention relates to an electrical plug-and-socket connector having first and second connector parts which each have a chamber housing for respectively holding complementary first and second electrical contact elements in which the first part has a latching element and the second part has a catch with the latching element reaching behind the catch when the two parts are connected with one another to prevent withdrawal of the parts from one another.

2. Background Art

Such electrical plug-and-socket connectors are used, among other places, in the automotive area. For example, such a connector is used to make contact with an actuator to activate a throttle valve of an internal combustion engine. A first part of the connector is a receptacle housing and a second part of the connector is a plug housing. The plug housing has a collar to protect its contacts which are arranged inside the collar.

In the prescribed embodiment, the plug housing is installed in a fixed location and the receptacle housing is at a free end of a connection cable harness. The receptacle housing includes a latching hook whose section that angles off from a contact spring represents the actual latching element. The latching hook itself is an integral part of the receptacle housing so that the necessary elasticity of the latching hook results from its material elasticity. On the outside, the plug housing has a catch which the latching element of the latching hook reaches behind after the two connector parts are properly connected. This serves as security against withdrawal.

When the receptacle housing is pushed onto the plug housing, the latching element is pressed away in the outward direction against the material elasticity resulting from the latching hook. The latching hook snaps back after passing the catch so that the latching element is then in its intended locked position in which it reaches behind the catch. There has to be axial play between the latching element of the latching hook and the catch in order for such snapping back to occur.

However, such axial play has a detrimental effect on the electrical connection between the contact elements of the first and second connector parts, especially if there are vibrations acting on the connector, as is the case when the connector is arranged directly on an internal combustion engine. This impairment can occur above all when only small or the smallest currents are being transferred.

Given the tolerances that have to be accepted during the manufacture of the two connector parts, the axial play has to also be dimensioned so that given unfavorable manufacturing tolerances axial play is present between the two connector parts to ensure the intended latching of the latching element.

SUMMARY OF THE INVENTION

The present invention provides an electrical plug-and-socket connector which avoids the disadvantages associated with axial play.

The electrical plug-and-socket connector includes a latching element which is adjustably connected to a first connector part such that when the latching element is in one position (i.e., the latching position) the latching element has sufficient axial play to latch behind a catch of a second connector part; and such that when the latching element is in its other position (i.e., the tensioned position) the latching element is tensioned and, in contrast to its latching position, moves in a direction opposite to that in which the two connector parts are joined in order to eliminate axial play between the two connector parts while maintaining the latching arrangement between the latching element and the catch of the two connector parts.

The latching element of the first connector part makes a latching movement while in the latching position to reach behind the catch of the second connector part. The latching element can also be moved out of its latching position into its tensioned position. When the latching element is in the tensioned position, the latching element is moved in the direction opposite to that in which the two connector parts are joined in order to eliminate axial play between the two connector parts while maintaining the latching arrangement between the two connector parts.

Moving the latching element in a direction opposite to that in which the two connector parts are joined after the latching element has been put in its latching position eliminates axial play that is present between the two connector parts. When this is done, it is expedient for the latching element to be pre-tensioned to a certain extent when it is in its tensioned position so that the two connector parts are securely connected free of play. The movement of the latching element in the direction opposite to that in which the two connector parts are joined can be either a translation or swing movement. In the latter case, the elimination of axial play is caused by a vector component of the swinging movement that is in the direction opposite to that in which the two connector parts are joined.

It is expedient for the latching element of the first connector part to be part of a latching hook which is connected to (for example, molded on) the first connector part by a coupling link. Expediently, the coupling link elastically reacts in the direction opposite to that in which the two connector parts are joined. The latching hook rests against a buttress of the first connector part when the latching hook is in the tensioned position. The buttress can be formed by a shoulder. It is expedient for the buttress shoulder to be bordered by an edge bulge over which a support catch associated with the latching hook is moved in order to rest on the buttress shoulder. The latching hook is then held locked in its tensioned position.

Another embodiment of the electrical plug-and-socket connector in accordance with the present invention provides that the latching hook of the first connector part has a pair of journals. Each journal engages into a two-position eye in the first connector part. The two journal positions are separated from one another by a dead point so that the latching hook is held stable in both latching and tensioned positions. The two journal positions are arranged relative to one another such that when the latching hook with its journals moves out of the latching position in which the two connector parts are joined and into the tensioned position in which the latching hook is tensioned, the actual latching element of the latching hook moves in the direction opposite to that in which the two connector parts are joined. The latching element moving in this opposite direction causes the two connector parts to move closer together such that axial play between the two connector parts is eliminated.

The coupling link in such an embodiment can have a meandering shape and extend approximately parallel to the longitudinal extension of the latching hook. The meandering shape gives the coupling link elasticity in the direction opposite to that in which the two connector parts are joined so that irrespective of the axial play that is actually present between the two connector parts the coupling link can take-up the tolerances.

The present invention provides an electrical plug-and-socket connector having first and second connector parts. The first connector part has a housing to hold first contacts. The second connector part has a housing to hold second contacts that are complementary to the first contacts. The second connector part further has a catch. A latching element is adjustably connected to the first connector part to be movable from a latching position to a tensioned position. When the connector parts are joined together along a first axial direction the connector parts have axial play with respect to one another to enable the latching element to latch behind the catch to prevent withdrawal of the connector parts from one another when the latching element is in the latching position. The latching element is tensioned to move in a second axial direction opposite to the first axial direction in order to eliminate the axial play between the connector parts while latching the connector parts together when the latching element is in the tensioned position.

The present invention also provides an electrical plug-and-socket connector having the first and second connector parts. A latching element is adjustably connected to the first connector part such that when the latching element is in a latching position the latching element has sufficient axial play to latch behind the catch of the second connector part to prevent withdrawal of the connector parts from one another when the connector parts are joined together, and such that when the latching element is in a tensioned position the latching element moves in a direction opposite to that in which the connector parts are joined together to eliminate axial play between the connector parts while maintaining the latching arrangement with the catch of the second connector part.

BRIEF DESCRIPTION OF THE DRAWINGS

The present invention is described below using sample embodiments which refer to the following figures.

DETAILED DESCRIPTION OF THE PREFERRED EMBODIMENT(S)

Figure 1:
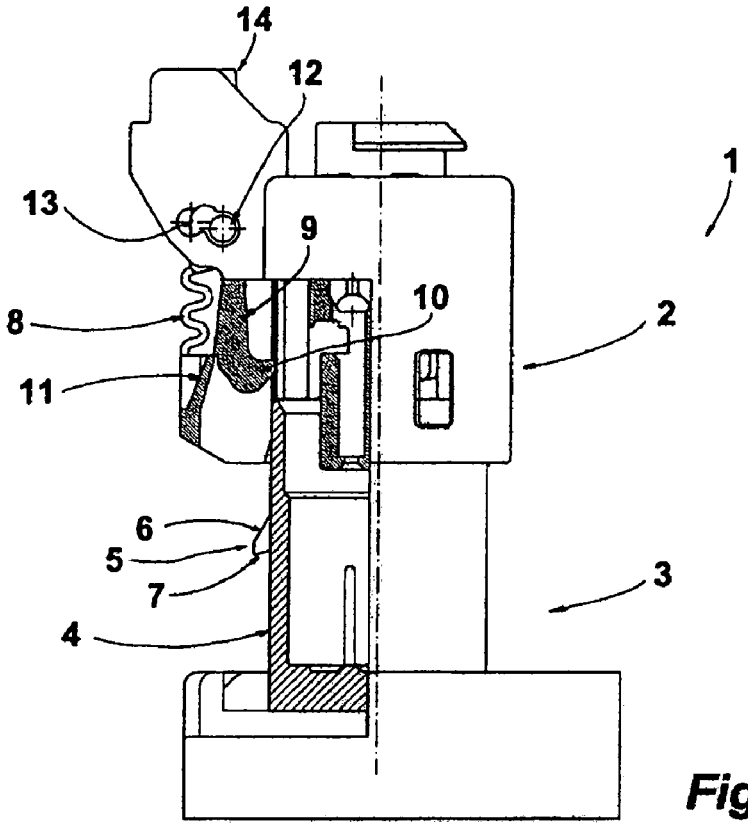
FIG. 1 illustrates a schematic, partially cut-away representation of an electrical plug-and-socket connector in accordance with the present invention in which the two connector parts have been brought together.

An electrical plug-and-socket connector 1 includes first and second plug-and-socket connector parts 2, 3. Each connector part 2, 3 has a chamber housing to hold contact elements which are complementary to one another. The chamber housing of connector part 2 is a receptacle housing to hold female contact elements. The chamber housing of connector part 3 is a plug housing to hold male contact elements. Connector part 3 is part of a unit that is not shown in detail. Connector part 2 forms a free end of a cable harness to connect the unit.

Connector part 3 includes a collar 4. Collar 4 includes a downward-projecting catch 5 arranged on its outside. Catch 5 has a positioning bevel 6 facing connector part 2 and a locking surface 7.

Connector part 2 includes a latching hook 9. Latching hook 9 includes a coupling link 8 having a meandering shape. Latching hook 9 has a hook section 10 which functions as a latching element to reach behind catch 5 of connector part 3 to lock together the two connector parts 2, 3. Connector part 2 further includes a contact spring 11. Contact spring 11 rests on the back of latching hook 9 and makes latching element 10 exert contact pressure on the outside surface of collar 4 of connector part 3. Latching hook 9 is guided with two diametrically opposite journals 12, which can be made as extensions, each of which is in a two-position bearing eye 13.

In FIG. 1, journals 12 are in a first journal position within bearing eyes 13. Latching hook 9 continues in an operating lever 14 extending upward from journals 12. Swinging operating lever 14 counterclockwise can take journals 12 out of their first position shown in FIG. 1 and put them into a second position of bearing eyes 13.

FIG. 1 illustrates the two connector parts 2, 3 as they are brought together, with collar 4 of connector part 3 already inserted into a corresponding collar groove of connector part 2. Thus, both connector parts 2, 3 have found one another. As the two connector parts 2, 3 are brought closer together, latching element 10 of latching hook 9 is moved along the outer surface of collar 4 of connector part 3. This further movement of connector parts 2, 3 toward one another joins them together bringing the electrical contact elements of connector part 3 into contact with the electrical contact elements of connector part 2.

Figure 2:
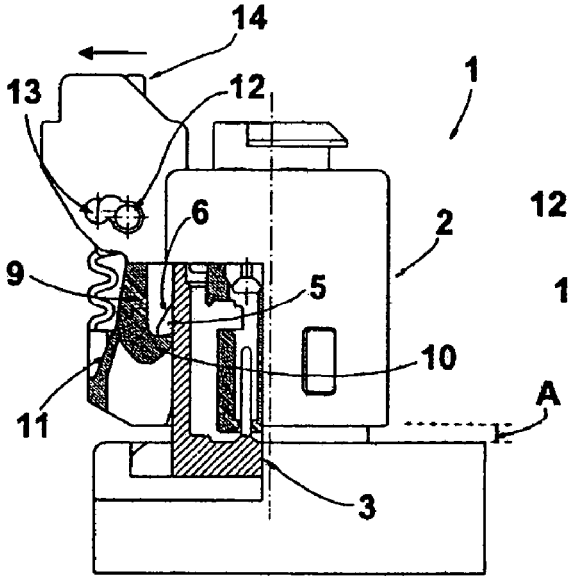
FIG. 2 illustrates the two connector parts of the connector shown in FIG. 1 that have been brought and joined together with the withdrawal security engaged.

This joining process moves latching element 10 of latching hook 9 over positioning bevel 6 of catch 5 and, under the force of contact spring 11, the latching element latches behind catch 5 in a perceptible and audible manner. This position is shown in FIG. 2. In order for latching element 10 to be able to latch or snap in behind catch 5 as intended, connector parts 2, 3 have a certain axial play (A) with respect to one another.

Figure 3:
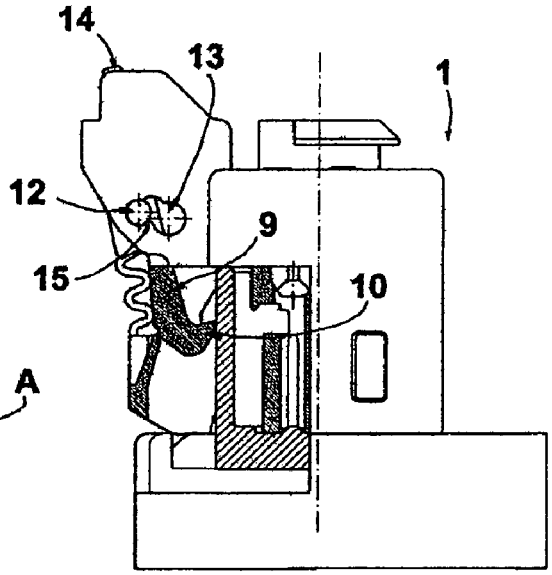
FIG. 3 illustrates the arrangement of FIG. 2 after axial play between the two connector parts of the connector has been eliminated.

In FIG. 2, latching hook 9 is still in the position shown in FIG. 1, in which journals 12 engage into the first journal position of bearing eyes 13. As can be seen in FIG. 2, latching element 10 reaches behind catch 5. To eliminate the axial play A remaining between connector parts 2, 3, operating lever 14 is now swung counterclockwise, as indicated by the arrow in FIG. 2, in order to put journals 12 into the second position of bearing eyes 13. This situation is shown in FIG. 3. A bulge 15 is between the two journal positions of bearing eyes 13. A bulge 15 provides a dead point so that in both positions latching hook 9 is held stable in bearing eyes 13. Moving operating lever 14 in the described way swings latching hook 9 with its latching element 10 about a virtual axis of rotation; a significant vector component of this swinging movement is in the direction opposite the direction in which connector parts 2, 3 are joined, so that making this movement moves connector parts 2, 3 toward one another, until no more axial play is present between connector parts 2, 3, as shown in the situation in FIG. 3. In the sample embodiment shown, the axis of rotation mentioned is approximately in the area where latching hook 9 rests on contact spring 11.

In this sample embodiment, the flexible design of coupling link 8 is expedient, especially in order to make it simple to take up manufacturing tolerances as well, to ensure that in any case the stroke of latching element 10 exerted by moving latching hook 9 eliminates even the greater axial play formed when manufacturing tolerances are unfavorable.

Figure 4:
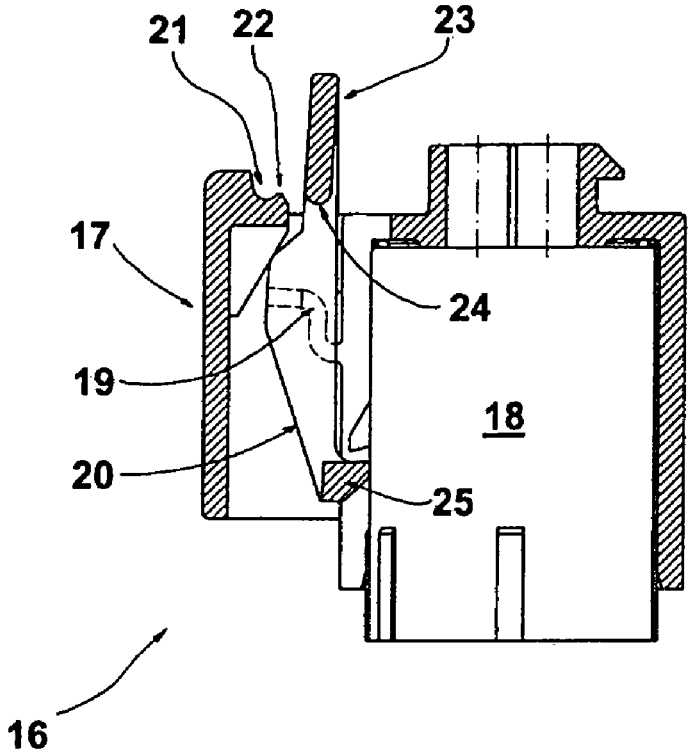
FIG. 4 illustrates the two connector parts of an electrical plug-and-socket connector joined together with one another before axial play between the two connector parts has been eliminated in accordance with another embodiment of the present invention.

FIG. 4 illustrates another plug-and-socket connector 16 having two plug-and-socket connector parts 17, 18. In principle, axial play is also eliminated in connector 16 in an analogous manner to that described for connector 1 shown in FIGS. 1, 2, and 3. In connector 16, connector part 17 has a latching hook 20 that is also formed by a coupling link 19. FIG. 4 illustrates connector parts 17, 18 after they have been joined with the two connector parts still having axial play between them.

Connector part 17 includes a shoulder 21. Shoulder 21 is bordered toward latching hook 20 by an edge bulge 22. Latching hook 20, like latching hook 9, has an operating lever 23. Operating lever 23 bears one or more support catches 24 on a side extension on the bottom.

Figure 5:
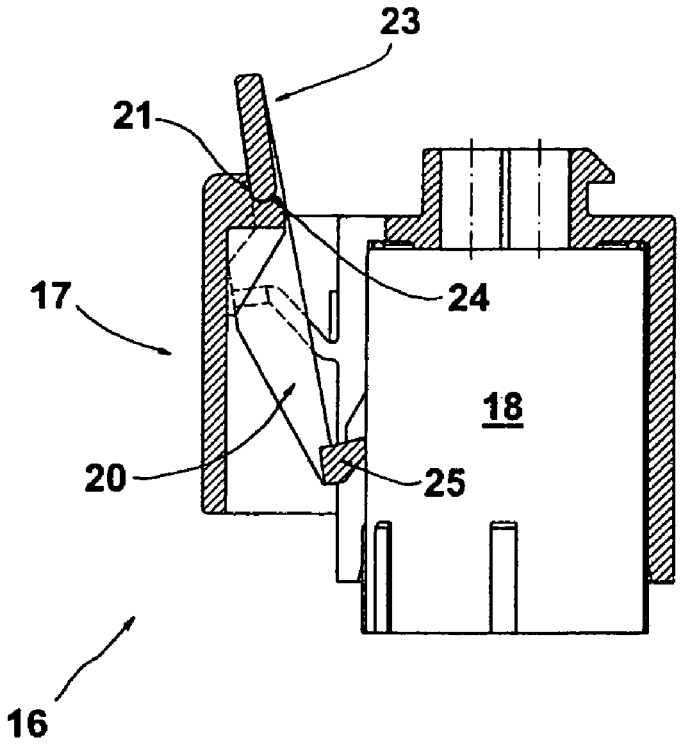
FIG. 5 illustrates the arrangement in FIG. 4 after axial play between the two connector parts of the connector has been eliminated.

Swinging operating lever 23 swings latching hook 20 along with it. When this is done hook element 25 of latching hook 20 exerts a stroke in the direction opposite that in which connector parts 17, 18 are joined so that this eliminates axial play remaining between the connector parts. FIG. 5 illustrates the position of this sample embodiment. Support catches 24 of operating lever 23 rest in shoulder 21. Edge bulge 22 holds support catches 24 securely in this position.

While embodiments of the present invention have been illustrated and described, it is not intended that these embodiments illustrate and describe all possible forms of the present invention. Rather, the words used in the specification are words of description rather than limitation, and it is understood that various changes may be made without departing from the spirit and scope of the present invention.

LIST OF REFERENCE NUMBERS

1 Plug-and-socket connector
2, 3 Plug-and-socket connector parts
4 Collar
5 Catch
6 Positioning bevel
7 Locking surface
8 Coupling link
9 Latching hook
10 Hook section
11 Contact spring
12 Journal
13 Bearing eye
14 Operating lever
15 Bulge
16 Plug-and-socket connector
17, 18 Plug-and-socket connector parts
19 Coupling link
20 Latching hook
21 Shoulder
22 Edge bulge
23 Operating lever
24 Support catch
25 Hook element
A Axial play

What is claimed is:

1. An electrical plug-and-socket connector comprising:

a first part having a housing to hold first contacts;

a second part having a housing to hold second contacts that are complementary to the first contacts, the second part further having a catch; and a latching element adjustably connected to the first part to be movable from a latching position to a tensioned position;

wherein when the parts are joined together along a first axial direction the parts have axial play with respect to one another to enable the latching element to latch behind the catch to prevent withdrawal of the parts from one another when the latching element is in the latching position;

wherein the latching element is tensioned to move in a second axial direction opposite to the first axial direction in order to eliminate the axial play between the parts while latching the parts together when the latching element is in the tensioned position;

wherein the latching element is part of a latching hook held with a coupling link that elastically reacts in the second axial direction when the latching element is in the tensioned position, and in the tensioned position the latching hook rests against a buttress of the first part.

2. The connector of claim 1 wherein:

the buttress includes a shoulder bordered by an edge bulge.

3. The connector of claim 1 wherein:

the latching hook includes two diametrically opposite journals, each journal engages in a two-position eye with a dead point separating the two journal positions of each eye.

4. The connector of claim 1 wherein:

the coupling link has a meandering shape and extends approximately parallel to a longitudinal extension of the latching hook that bears the latching element.

5. The connector of claim 1 wherein:

the first part includes a contact spring which acts on the latching element in the first axial direction for the latching element to reach behind the catch of the second part.

6. The connector of claim 1 wherein:

the housing of the first part is a receptacle housing, the housing of the second part is a plug housing having a collar, the catch of the second part is on an exterior surface of the collar of the second part.

7. An electrical plug-and-socket connector comprising:

a first part having a housing to hold first contacts;

a second part having a housing to hold second contacts that are complementary to the first contacts, the second part further having a catch; and a latching element adjustably connected to the first part such that when the latching element is in a latching position the latching element has sufficient axial play to latch behind the catch of the second part to prevent withdrawal of the parts from one another when the parts are joined together, and such that when the latching element is in a tensioned position the latching element moves in a direction opposite to that in which the parts are joined together to eliminate axial play between the parts while maintaining the latching arrangement with the catch of the second part;

wherein the latching element is part of a latching hook held with a coupling link that elastically reacts in the direction opposite to that in which the parts are joined together when the latching element is in the tensioned position, and in the tensioned position the latching hook rests against a buttress of the first part.

8. The connector of claim 7 wherein:

the buttress includes a shoulder bordered by an edge bulge.

9. The connector of claim 7 wherein:

the latching hook includes two diametrically opposite journals, each journal engages in a two-position eye with a dead point separating the two journal positions of each eye.

10. The connector of claim 7 wherein:

the coupling link has a meandering shape and extends approximately parallel to a longitudinal extension of the latching hook that bears the latching element.

11. The connector of claim 7 wherein:

the first part includes a contact spring which acts on the latching element in the direction in which the parts are joined together for the latching element to reach behind the catch of the second part.

12. The connector of claim 7 wherein:

the housing of the first part is a receptacle housing, the housing of the second part is a plug housing having a collar, the catch of the second part is on an exterior surface of the collar of the second part.

13. An electrical plug-and-socket connector comprising:

a first part having a housing to hold first contacts;

a second part having a housing to hold second contacts that are complementary to the first contacts, the second part further having a catch;

a latching element adjustably connected to the first part such that when the latching element is in a latching position the latching element has sufficient axial play to latch behind the catch of the second part to prevent withdrawal of the parts from one another when the parts are joined together, and such that when the latching element is in a tensioned position the latching element moves in a direction opposite to that in which the parts are joined together to eliminate axial play between the parts while maintaining the latching arrangement with the catch of the second part.

14. The connector of claim 13 wherein:

the first part includes a contact spring which acts on the latching element in the first axial direction for the latching element to reach behind the catch of the second part.

15. The connector of claim 13 wherein:

the housing of the first part is a receptacle housing and the housing of the second part is a plug housing.

16. The connector of claim 15 wherein:

the plug housing of the second part has a collar, wherein the catch of the second part is on an exterior surface of the collar.

* * * * *